US005373650A

United States Patent [19]

Dananberg et al.

[11] Patent Number: 5,373,650

[45] Date of Patent: Dec. 20, 1994

[54] HIGH-HEELED SHOE ORTHOTIC DEVICE

[75] Inventors: Howard J. Dananberg, Bedford, N.H.; Justin Wernick, New York, N.Y.

[73] Assignee: Langer Biomechanics Group, Inc., Deer Park, N.Y.

[21] Appl. No.: 164,423

[22] Filed: Dec. 8, 1993

Related U.S. Application Data

[63] Continuation of Ser. No. 863,188, Apr. 3, 1992, abandoned.

[51] Int. Cl.[5] ..... A43B 7/16; A43B 13/38

[52] U.S. Cl. ..... 36/92; 36/43; 36/173; 36/172; 36/178

[58] Field of Search ..... 36/43, 44, 71, 91, 92, 36/140, 145, 166, 169, 173, 181, 172, 174, 178, 180

[56] References Cited

U.S. PATENT DOCUMENTS

| | | | |
|---|---|---|---|
| Re. 18,237 | 10/1927 | Messler . | |
| 1,196,410 | 8/1916 | Walker | 36/173 |
| 1,417,170 | 5/1922 | Hosmer | 36/140 |
| 1,693,398 | 7/1927 | Miller et al. . | |
| 1,832,659 | 11/1931 | Riley | 36/176 |
| 1,992,081 | 2/1935 | Madinger | 36/178 |
| 2,088,263 | 7/1937 | Grouven | 36/169 |
| 2,157,026 | 5/1939 | Sochor | 36/178 |
| 2,238,366 | 4/1941 | Leydecker | 36/180 |
| 2,254,353 | 5/1940 | Cocozella | 36/2.5 |
| 2,254,353 | 5/1941 | Burns | 36/178 |
| 2,309,775 | 7/1942 | Levitt | 12/133 |
| 2,370,789 | 11/1942 | Glagovsky | 36/19.5 |
| 2,394,780 | 6/1943 | Iredale | 144/309 |
| 2,415,580 | 2/1947 | Davis | 36/140 |
| 2,465,817 | 3/1948 | Perugia | 33/8.5 |
| 2,641,066 | 9/1950 | Filardo | 36/8.5 |
| 2,823,469 | 2/1956 | Eberhart | 36/178 |
| 2,852,865 | 12/1957 | Spalding | 36/37 |
| 2,931,110 | 2/1958 | Pietrocola | 36/30 |
| 4,196,485 | 4/1980 | Wilkinson | 12/147 |
| 4,232,457 | 11/1980 | Mosher | 36/166 |
| 4,250,886 | 2/1981 | Riso et al. | 128/621 |
| 4,411,076 | 10/1983 | Wilkinson | 36/34 |
| 4,412,364 | 11/1983 | Orea Mateo | 12/146 |
| 4,523,345 | 6/1985 | Oreo Mateo | 12/133 |
| 4,631,841 | 12/1986 | Hickey | 36/91 |
| 4,670,996 | 6/1987 | Dill | 36/42 |
| 4,686,993 | 8/1987 | Grombine | 36/140 |
| 4,759,357 | 7/1988 | Allart et al. | 36/140 |
| 4,823,420 | 4/1989 | Bartneck | 36/44 |

FOREIGN PATENT DOCUMENTS

| | | | |
|---|---|---|---|
| 674597 | 11/1963 | Canada | 12/134 |

OTHER PUBLICATIONS

Journal of the American Podiatry Association vol. 70, No. 3 Mar., 1980. Footwear and the Podiatrist "Footwear Fashion Cycles" by: William A. Rossi, DPM pp. 156–157.

Textbook of Orthopedic Mecicine, vol. One, 7th Edition by: James Cyriax, 1978. "Diagnosis of Soft Tissue Lesions" pp. 682–683.

*Primary Examiner*—Paul T. Sewell
*Assistant Examiner*—Marie Denise Patterson
*Attorney, Agent, or Firm*—Hayes, Soloway, Hennessey, Grossman and Hage

[57] ABSTRACT

An orthotic device for insertion into a high-heeled shoe is provided. An orthotic device made in accordance with the instant invention virtually eliminates the problems associated with the wearing of high-heeled shoes, particularly pronation effects, general foot discomfort, posture problems, toe pain, and arch pain. The orthotic device comprises a right or semi-rigid shell for positioning beneath the heel of the foot and extending forwardly towards the toes of the foot. The shell terminates behind the five metatarsal heads of the foot, and is shaped whereby to permit the first metatarsal head freely to evert and plantarflex under load, and is shaped such that the heel of the foot is carried substantially parallel to or slightly backwardly inclined relative to the ground plane.

17 Claims, 4 Drawing Sheets

HIGH-HEELED SHOE ORTHOTIC DEVICE

This is a continuation of copending application Ser. No. 07/863,188 filed on Apr. 3, 1992.

BACKGROUND OF THE INVENTION

1. Field of the Invention

This invention relates generally to orthotic devices, and more specifically to orthotic devices for use in high-heeled shoes.

The human foot may be subject to a number of abnormalities which cause pain. A number of corrective constructions have been devised for curing these problems. These corrective constructions are generally referred to in the art as "orthotics" and may be integrally formed in a shoe or adapted to be received by a shoe. Such orthotic devices commonly are used to correct abnormalities and/or to prevent foot problems or injury arising from the wearing of high-heeled dress shoes. While there has been substantial investigation by prior art workers into orthotic devices for use with athletic footwear, there has been little work into designing orthotics for reducing injury or increasing comfort of high-heeled dress shoes.

A standard high-heeled dress shoe is designed so that the heel of the foot wearing the shoe is carried higher than its toes. The height differential between the heel and the toes can vary significantly depending on the style of the shoe. It is not uncommon for heel heights to range from 1½" to 3" or more above the toes in certain styles. Also, high-heeled shoes typically are designed with pointed toes in order to exhibit greater fashion appeal. While the design of these pointed toes also vary, it is generally common for fashion high-heeled shoes to maintain pointed toes regardless of the shape of the wearer's foot. A number of painful foot problems result from this design. For example, the downward slant of the inner sole of the shoe forces the wearer's foot to slide forward toward the toes. As the foot slides forward, the toes become jammed in the toe portion of the shoe. This can be very painful and it has been shown that at least 85% of all high-heeled shoe wearers experience such pain. Moreover, the downside slant of the inner sole places stress on the foot as the foot attempts to conform to the downward slant of the inner sole, causing the heel bone or calcaneus, to tilt downward, or plantarflex, thereby locking the first metatarsal phalangeal joint and preventing hallux extension or "toe lock". This causes the foot to pronate, greatly decreasing the overall foot comfort as well as adversely effecting the wearer's posture and ambulation all as described in U.S. Pat. No. 4,597,195 to Dananberg, one of the inventors hereof. Therefore, wearers of high-heeled shoes often complain of problems associated with toe pain, arch pain, as well as general lower back problems.

Unfortunately, no teaching exists in the prior art to construct an orthotic device that adequately corrects foot posture while permitting conventional high-heeled shoes to be worn. Typically, an orthotic device consists of several components: the heel post of rear stabilizer component located directly beneath the heel seat of the orthotic, the shell or arch accommodating section which runs from the heel to a point just behind the metatarsal heads of the foot; and the extension component that runs from a point at the end of the orthotic shell to the point where the toes join the body of the foot, commonly called the sulcus.

Richardson et al, U.S. Pat. No. 1,778,002 discloses an orthotic in which the shank is provided with extensions which are intended to act as an arch support. The shank extensions contemplated in Richardson extend laterally from the shank of the sole, extending outwardly at en acute angle with respect to the sole. The disadvantage of this construction is that it requires a sole with relatively high sides to protect or conceal Richardson's orthotic device. Moreover, the wider or higher such lateral extensions are, the more pressure may be exerted on the side or arch, vamp, foxing, and order of the shoe, thereby distorting the shape of the shoe itself.

It is also known in the prior art to provide orthotics comprising pads attached to the insole. These may take the form of metatarsal pads, midtarsal pads, or heel spur pads, such as those disclosed by Riehle et al, U.S. Pat. No. 1,867,679, Frese, Jr. in U.S. Pat. No. 2,959,875, Nalick, U.S. Pat. No. 3,777,419, and Stemmons, U.S. Pat. No. 2,075,552.

Riso et al, U.S. Pat. No. 4,250,886 discloses an orthotic for a high-heeled shoe and comprising a sole including heel and forefoot receiving portions, the heel portion being elevated approximately 1½" about the forefoot portion. Riso's orthotic also provides a metatarsal pad secured to the sole and dimensioned so as to have one marginal edge substantially adjacent and proximal to the head of the second metatarsal, a second metatarsal edge substantially adjacent and lateral the first metatarsal and a third metatarsal edge substantially adjacent and medial to the fifth metatarsal. However, Riso requires that the orthotic position of the foot such that a constant height of 1½" is maintained between the heel and forefoot even if the heel height exceeds 1½". Thus, in a shoe with a standard heel height of 1¾" an orthotic made in accordance with Riso would place a ¼" pad under the forefoot to maintain the constant 1½" between the heel and the forefoot, and a 2" heel would require a ½" pad under the forefoot. The inclusion of a pad of ¼"–½" thickness in a modern high-heeled shoe would crowd the wearer's toes, resulting in toe pain, and exacerbating the problem of toe lock discussed in Dananberg U.S. Pat. No. 4,597,195.

OBJECTS OF THE INVENTION

An object of the present invention is to provide an orthotic device adapted for insertion into a high-heeled shoe which overcomes the aforesaid and other problems of the prior art. A more specific object of the present invention is to provide an orthotic device that is capable of eliminating toe pain and toe lock of the wearer of a high-heeled dress shoe.

Yet another object of the present invention is to provide an orthotic device that is capable of improving the wearer's posture, general foot comfort, and of eliminating foot arch pain as well as general lower back pain.

A still further object of the present invention is to provide an orthotic device that is useful in high-heeled shoes having a wide range of heel heights including heel heights of two or more inches.

SUMMARY OF THE INVENTION

The present invention provides an orthotic device adapted to be inserted into a heeled shoe defining a ground plane and also being adapted for receiving a human foot thereon. The orthotic device contemplated by the instant invention comprises a rigid or semi-rigid shell for positioning beneath the heel of the foot, and extending forwardly toward the toes, but terminating behind all of the five metatarsal heads, and is shaped such that the first metatarsal head specifically can be allowed to plantarflex and evert under load. The rigid or semi-rigid shell has a shape such that the heel of the foot is carried substantially parallel to the ground plane, or the heel is tilted slightly backwards. Typically, the part of the shell underlying the heel will be tilted at an angle of from about 4 to about 22.5 degrees to accommodate for the downward slant of the shoe. The actual angle is related to shoe heel height. The higher the heel, the greater the accommodative angle.

In a preferred embodiment of the invention the orthotic device also comprises a heel post attached to the shell for positioning beneath the heel of the foot, and extending forwardly toward the toes of the foot. The heel post terminates behind the heel bone of the foot and is adapted to assist the shell in carrying the heel of the foot in a substantially parallel position relative to the ground plane. Also, in a preferred embodiment of the instant invention the heel post has a thickness that assists the shell in carrying the heel of the foot in a substantially parallel or slightly tilted back position, and specifically may have a thickness that increases from the heel of the foot towards the toes thereof and from an outer portion of the foot towards the arch thereof.

Other variations and modifications are possible. For example, the curved portion of the shell is adapted as a function of the height of the heel of the shoe above the ground plane in order better to carry the heel of the foot in the aforementioned substantially parallel or slightly tilted back position relative to the ground plane. Also, in other modifications, the orthotic device may also, comprise a recessed heel portion that is adapted to receive the heel of the foot, and a cushioned, flexible extension component is attached to the shell and positioned beneath the heel, and extending forwardly toward the toes of the foot to terminate behind the sulcus of the foot.

BRIEF DESCRIPTION OF THE DRAWINGS

Other features of the present invention will become apparent as the following description proceeds and upon reference to the drawings, wherein like numerals represent like parts and, in which.

While the present invention will hereinafter described in connection with preferred embodiments and methods of use, it will be understood by those skilled in the art that it is not intended to limit the invention to these embodiments. On the contrary, it is intended to cover all alternatives, modifications, and equivalents, as may be included within the spirit and broad scope of the invention as defined only by the appended claims.

DETAILED DESCRIPTION OF THE PREFERRED EMBODIMENTS

Figure 1:
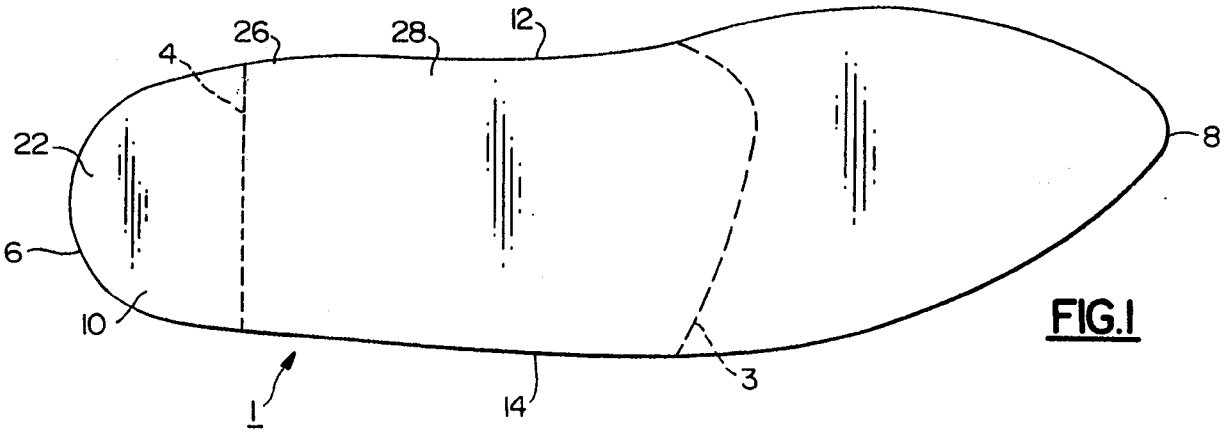
FIG. 1 is a top view of one preferred embodiment of the instant invention.
Figure 2:
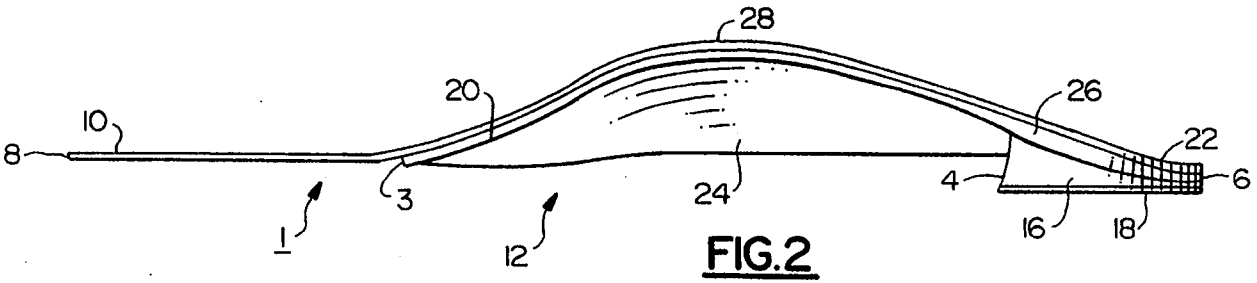
FIG. 2 is a side view along the inward portion of the preferred embodiment depicted in FIG. 1.
Figure 3:
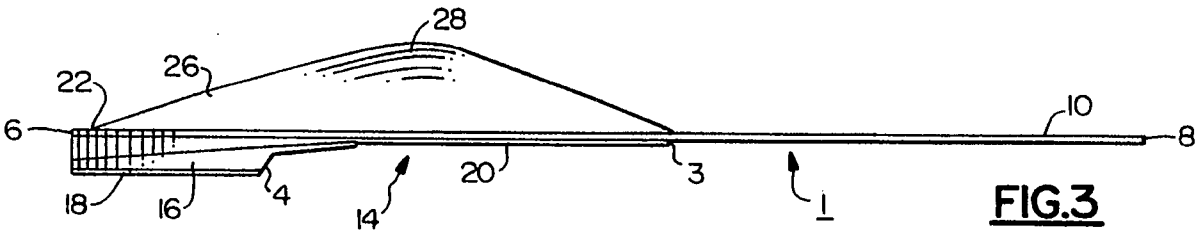
FIG. 3 is a side view of an outward portion of the preferred embodiment depicted in FIGS. 1 and 2.
Figure 4:
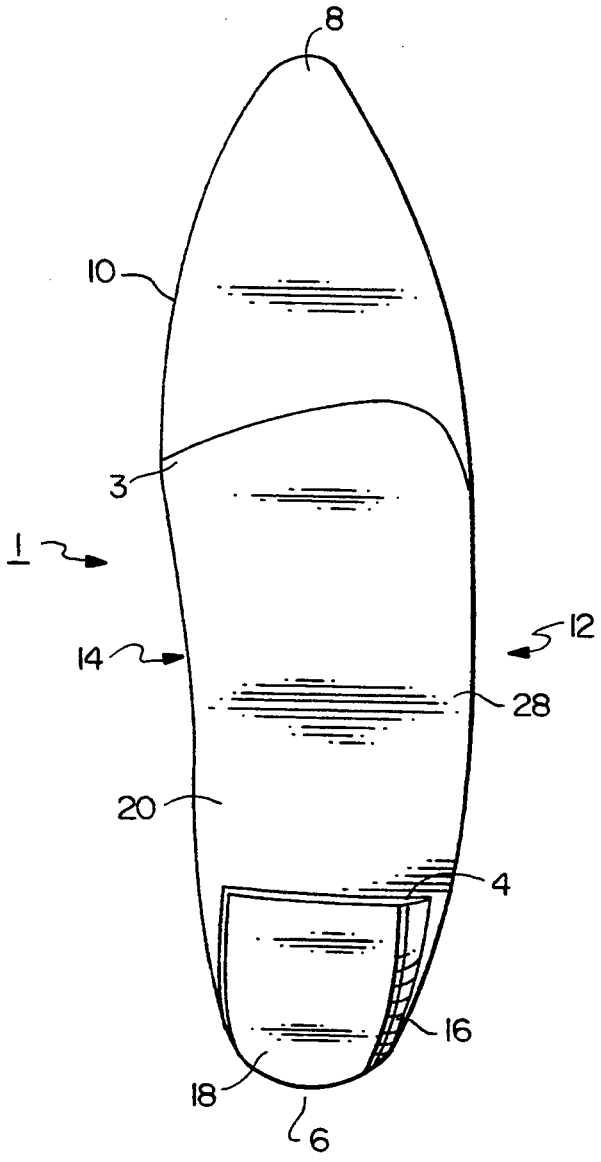
FIG. 4 is a bottom view of the preferred embodiment depicted in FIGS. 1–3.
Figure 5:
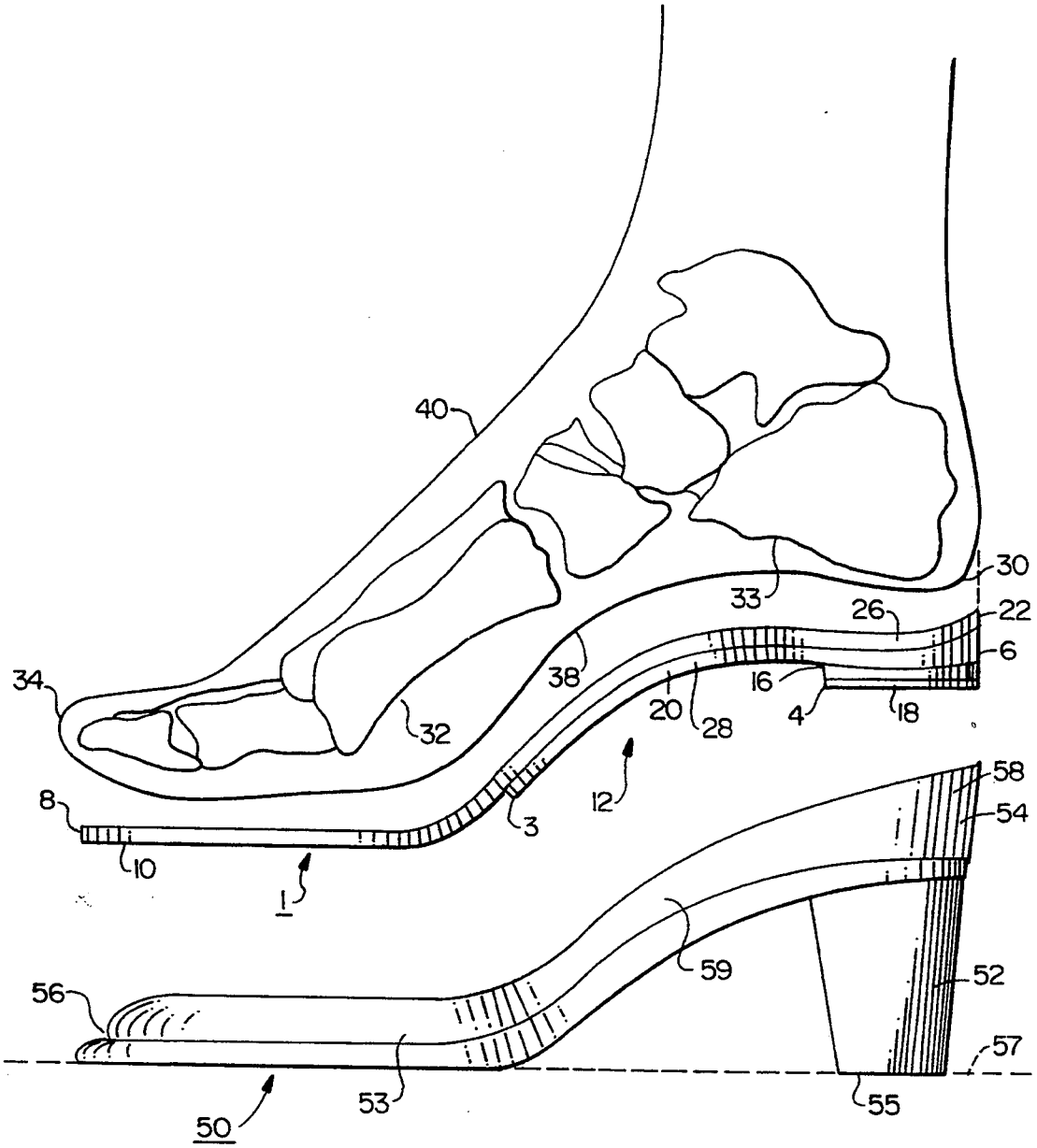
FIG. 5 is a diagrammatic view of the embodiment depicted in FIGS. 1–4 with the skeletal outline of a human foot disposed thereon.
Figure 6:
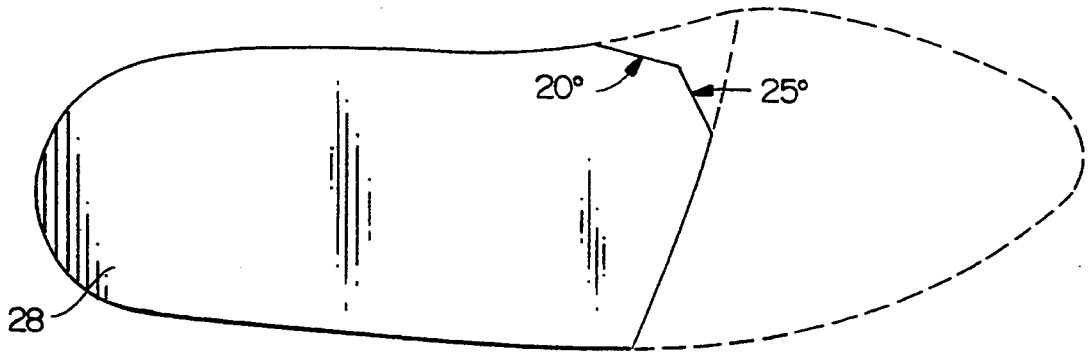
FIG. 6 is a top view showing details of the toe end of the orthotic device made in accordance with the present invention.
Figure 7:
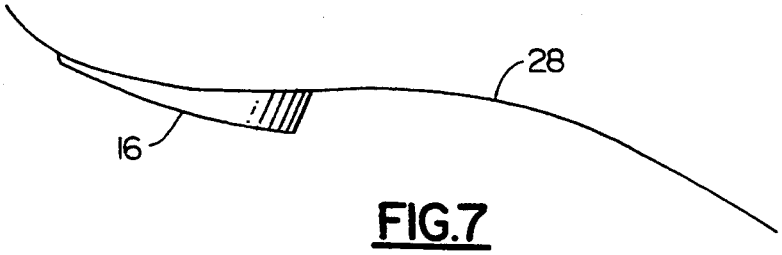
FIG. 7 is a side view similar to FIG. 2, and showing details of a heel post construction in accordance with the present invention.
Figure 8:
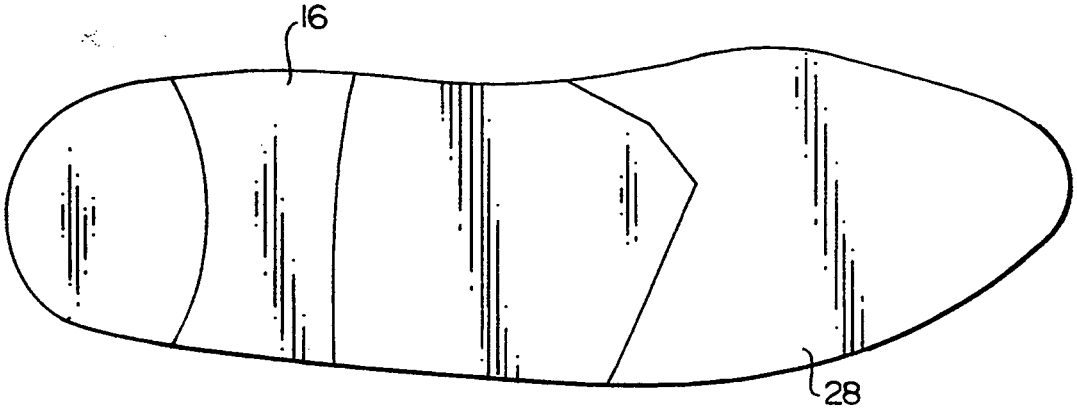
FIG. 8 is a bottom view of the alternative embodiment depicted in FIG. 7.

Turning to the drawings, there is provided an orthotic device 1 adapted to be inserted into a high-heeled shoe which is shown relative to a ground plane 57 formed by the intersection of the bottom 53 of the foreshoe 56 and the bottom 55 of the heel 52. The orthotic device 1 contemplated by the instant invention is adapted for receiving a human foot 40 thereon and comprises a rigid or semi-rigid shell 28 for positioning beneath the heel 30 of the foot 40 and extending forwardly toward the toes 34 of the foot 40. Referring in particular to FIG. 6, at the forward or toe end 3 of the rigid or semi-rigid shell 28, i.e. at the point on the orthotic where the first metatarsal shaft comes in contact with the shell, an area is removed from the shell so as to permit the first metatarsal head to evert and plantarflex under load. More particularly, from a point approximately 1 cm distally (towards toes) from the base of the first metatarsal head, material is removed on an approximate 20 degree angle from the medial side of the orthotic. This is carried to a point approximately 1 cm from the toe end of the shell 28. A second cut with material removed is then made 20 to 25 degrees to the first cut, and this terminates at the end 3 of the shell 28 adjacent to the medial side of the second metatarsal of the foot 40. Shell 28 is shaped, as shown in FIG. 5, such that the heel 30 of the foot 40 is carried substantially parallel or inclined slightly backward to the ground plane 57. In the particular embodiment illustrated in the instant figures, the instant orthotic device also comprises a heel post 16 that is attached to the shell 28 and also positioned beneath the heel 30 of the foot 40. The post 16 extends forwardly toward the toes 34 of the foot and terminates at 4 behind substantially immediately the heel bone 33 of the foot 40. Preferably, the post 16 is adapted to assist the shell 28 in carrying the heel 30 in the substantially parallel or slightly backwardly inclined position relative the ground plane 57. Also, preferably, the heel post 16 is of a thickness to assist the shell 28 in carrying the heel 30 by increasing the thickness of the post 16 from the heel 30 or back part of the orthotic 6 toward the toes 34 or front part 8 of the orthotic and from an outer part 14 of the foot 40 toward the arch 38 or inner portion 12 thereof. Preferably, as shown in FIGS. 7 and 8, post 16 extends from a point under the most distal (toe side) portion of the shell 28 under the heel approximately 1–1.5 cm so as to accommodate the slant of the high-heeled shoe without raising the heel of the wearer out of the back of the counter.

Further preferably, the shell 28 at a mid portion 20 corresponding to the arch 38 of the foot 40 is curved to provide support to the arch 38. Preferably, the curvature of the shell 28 increases from the back portion 6 of the orthotic to a maximum at the midpoint 20 of the shell 28 and then decreases toward the termination point 3 and also increases from the outward portion 14 towards the inward portion 12. Other curvatures are also possible, so long as any such curvature is adapted to properly support the arch 38 of the foot 40 with the heel 30 of the foot 40 carried substantially parallel to or inclined slightly backwardly to the ground plane, and the shell terminates slightly rearwardly of the first metatarsal head 32 of the foot 40.

Additionally, the orthotic device made in accordance with the present invention may comprise a cushioned. flexible extension component 10 that is attached to the shell 28 and is also positioned beneath the heel 30 and extends forwardly toward the toes 34 of the foot 40. The extension component 10 terminates at 8 behind the sulcus of the foot 40. Preferably, the extension component is made of a soft cushioning material such as PPT, or other soft cushioning materials as are well known in the art. Furthermore, although the shell 28 and heel post 16 are preferably formed of a hard rigid substance such as plastic or hard foam, other materials may also be used so long as such materials allow the heel 30 of the foot 40 to be kept substantially parallel or inclined slightly backwardly to the ground plane 57.

In use, the orthotic device 1 is placed within a high-heeled shoe 50 so that the back end 6 of the device 1 is flush with the back 58 of the top portion 54 of the shoe 50 and the front or toe portion 8 of the device is nearby the front 56 part of the shoe 50 and point 3 terminates slightly rearwardly of the first metatarsal bend 32 of the foot. In this embodiment, the extension component 10 is within the forefoot 53 while the shell 28 is carried within the incline portion 59 and the heel post 16 is carried directly above the heel 52. When the foot 40 is inserted into the shoe 50 and placed on top of the orthotic 1, preferably, the heel 30 is received into a recessed heel portion 26 that has been so adapted to receive the heel 30. The arch 38 of the foot is carried and supported by the curved portion of the rigid or semi-rigid shell 28, while the first metatarsal head 32 of the foot is left unsupported by the orthotic, and thus is free to flex. The entire foot, however, rests upon the cushioned flexible extension component 10 to provide additional wearer comfort.

As will be seen by those skilled in the art, the instant orthotic device provides many advantages over the prior art. Most important among these advantages is that the heel 30 of the foot 40 is carried by the orthotic 1 such that it is substantially parallel to or inclined backwardly to the ground plane 57. This greatly reduces the forward inclination force of the foot 40 toward the toe part 56 of the shoe 50 and therefore prevents the toes 34 of the foot 40 from becoming jammed therein, thus increasing general foot comfort and also improves posture. Thus, it would be appreciated that the instant orthotic eliminates the toe pain and general lower back pain associated with the wearing of heeled shoes and particularly the wearing of high-heel shoes. Also, since the arch 38 is supported by the curved portion of the shell 28, while the first metatarsal head is left unsupported by the orthotic, the first metatarsal is free to evert and plantarflex under load. Thus, arch pain, indemic with the use of high-heeled shoes, is virtually eliminated using the instant orthotic.

Also, advantageously, the instant invention permits many variations without departing from the instant invention. For example, the thickness and thickness distribution of the heel post 16 may be adapted as necessary in order to keep the heel 30 of the foot 40 in substantially parallel or slightly backwardly inclined relationship to the ground plane 57. Thus, for example, in heels having 1" or less height, the thickness of the post will be slight as compared to the height of the back 58 of the shoe 50, while in shoes with greater heel height, for instance, 2", the thickness of the post 16 may be made thicker toward the toes 34 or front end 8 of the orthotic so as to accommodate the increased angle of the arched portion 59 of the shoe 50 relative to the ground plane 57. Thus, it can be seen that a great many alterations may be made to the instant orthotic to account for changes in heel heights relative to the ground plane 57. Indeed, if needed, the heel post portion 16 may be eliminated entirely so that the shell 28 rests directly above the heel 52 of the shoe 50.

It is, therefore, evident that there is provided, in accordance with the present invention, an orthotic device that fully satisfies both the aims and objectives hereinbefore set forth. While this invention has been described in conjunction with specific embodiments thereof, it will be evident to those skilled in the art that many alternatives, modifications, and variations are possible without departing from the scope of the instant invention. Accordingly, it is intended to embrace all such alternatives, modifications, and variations as fall within the spirit and broad scope of the appended claims.

What is claimed is:

1. An orthotic device for insertion into a high-heeled shoe for a human foot and being removable from said shoe, said shoe having a foreshoe and a heel, each having a bottom, the bottom of said foreshoe and the bottom of said heel being coplanar and defining a ground plane, said device comprising:

a. a shell dimensioned to underlie the heel of said foot and extending forwardly toward the toes of said foot, said shell terminating behind the five metatarsal heads of said foot and having a cutaway portion under the first metatarsal head of said foot, whereby the first metatarsal head of said foot is left unsupported by the orthotic, so as to permit the first metatarsal head freely to evert and plantarflex under load; and b. a heel post attached to said shell and dimensioned to directly underlie the heel of said foot and extending forwardly toward the toes of said foot, said heel post terminating behind the heel bone of said foot, said heel post and said shell having a thickness distribution that increases from the heel of said foot toward the toes thereof to carry said heel of said foot backwardly inclined at an angle of between about 4 degrees and about 22.5 degrees relative to the ground plane.

2. An orthotic device according to claim 1, and further comprising a cushioned, flexible extension component attached to said shell and extending forwardly toward and dimensioned to at least partially underlie the toes of said foot.

3. An orthotic device according to claim 2, wherein said cushioned, flexible extension component extends beyond said shell from the edge of said shell forwardly toward the toes.

4. An orthotic device according to claim 1, and further comprising a recessed heel portion dimensioned to underlie the heel of said foot.

5. An orthotic device according to claim 1, wherein said shell has a curved portion dimensioned to underlie and support the arch of said foot.

6. An orthotic device for insertion into a high-heeled shoe for receiving a human foot and being removable from said shoe, said shoe having a foreshoe and a heel, each having a bottom, the bottom of said foreshoe and the bottom of said heel being coplanar and defining a ground plane, said device comprising:

a. a shell dimensioned to underlie the heel of said foot and extending forwardly toward the toes of said foot, said shell terminating behind the five metatarsal heads of said foot and having a cutaway portion under the first metatarsal head of said foot, whereby the first metatarsal head of said foot is left unsupported by the orthotic, so as to permit the first metatarsal head freely to evert and plantarflex under load, said shell having a curved portion to support the arch of said foot; and b. a heel post attached to said shell and dimensioned to directly underlie the heel of said foot and extending forwardly toward the toes of said foot, said heel post terminating behind the heel bone of said foot, said heel post and said shell having a thickness distribution that increases from the heel of said foot toward the toes thereof to carry the heel of said foot backwardly inclined at an angle of between about 4 degrees and about 22.5 degrees relative to said ground plane.

7. An orthotic device according to claim 6, and further comprising, a cushioned, flexible extension component attached to said shell and extending forwardly toward and dimensioned to underlie the toes of said foot.

8. An orthotic device according to claim 7, wherein said cushioned, flexible extension extends beyond said shell from the edge of said shell forwardly toward the toes.

9. An orthotic device for insertion into a high-heeled shoe for a human foot and being removable from said shoe, said shoe having a foreshoe and a heel, each having a bottom, the bottom of said foreshoe and the bottom of said heel being coplanar and defining a ground plane, said device comprising, a shell dimensioned to underlie the heel of said foot and extending forwardly toward the toes of said foot, said shell terminating adjacent the five metatarsal heads of said foot and having a cutaway portion under the first metatarsal head of said foot, whereby the first metatarsal head of said foot is left unsupported by the orthotic, so as to permit the first metatarsal head freely to evert and plantarflex under load, said shell having a thickness distribution to carry the heel of said foot backwardly inclined at an angle of between about 4 degrees and about 22.5 degrees relative to the ground plane.

10. An orthotic device according to claim 9, wherein said shell has a curved portion dimensioned to underlie and support the arch of said foot and to assist in carrying said heel of said foot.

11. An orthotic device according to claim 9, and further comprising, a heel post attached to said shell and dimensioned to directly underlie the heel of said foot and extending forwardly toward the toes of said foot, said heel post terminating behind the heel bone of said foot, said heel post in concert with said shell carrying the heel of said foot.

12. An orthotic device according to claim 11, wherein said post has a thickness that increases from the heel of said foot toward the toes thereof and from an outer part of said foot toward the arch thereof.

13. An orthotic device for insertion into a high-heeled shoe for a human foot and being removable from said shoe, said shoe having a foreshoe and a heel, each having a bottom, the bottom of said foreshoe and the bottom of said heel being coplanar and defining a ground plane, said device comprising:

a. a shell dimensioned to underlie the heel of said foot and extending forwardly toward the toes of said foot, said shell terminating behind the five metatarsal heads of said foot and having a cutaway portion under the first metatarsal head of said foot, whereby the first metatarsal head of said foot is left unsupported by the orthotic, so as to permit the first metatarsal head freely to evert and plantarflex under load; and b. a heel post attached to said shell and dimensioned to directly underlie the heel of said foot and extending forwardly toward the toes of said foot, said heel post terminating behind the heel bone of said foot, said heel post and said shell having a thickness distribution that increases from the heel of said foot toward the toes thereof and from an outer part of said foot toward the arch thereof to carry said heel of said foot backwardly inclined at an angle of between about 4 degrees and about 22.5 degrees relative to the ground plane.

14. An orthotic device according to claim 13, and further comprising a cushioned, flexible extension component attached to said shell and extending forwardly toward and dimensioned to at least partially underlie the toes of said foot.

15. An orthotic device according to claim 14, wherein said cushioned, flexible extension component extends beyond said shell from the edge of said shell forwardly toward the toes.

16. An orthotic device according to claim 13, and further comprising a recessed heel portion dimensioned to underlie the heel of said foot.

17. An orthotic device according to claim 13, wherein said shell has a curved portion dimensioned to underlie and support the arch of said foot.

* * * * *